United States Patent [19]

Davis

[11] 4,063,512

[45] Dec. 20, 1977

[54] ARMOR PENETRATING PROJECTILE

[75] Inventor: Dale M. Davis, Freeport, Fla.

[73] Assignee: The United States of America as represented by the Secretary of the Air Force, Washington, D.C.

[21] Appl. No.: 584,944

[22] Filed: Oct. 5, 1966

[51] Int. Cl.[2] ..... F42B 11/14

[52] U.S. Cl. ..... 102/52; 102/56 SC

[58] Field of Search ..... 102/24 HC, 49, 52, 53, 102/56–59, 67, 68, 70.2 GI, 22, 56 SC

[56] References Cited

U.S. PATENT DOCUMENTS

| | | | |
|---|---|---|---|
| 2,137,436 | 11/1938 | Barnhart | 102/52 X |
| 2,595,960 | 5/1952 | Lawrence | 102/24 HC |
| 2,623,465 | 12/1952 | Jasse | 102/56 X |
| 2,804,823 | 9/1957 | Jablansky | 102/49.6 X |
| 2,849,957 | 9/1958 | Küller et al. | 102/56 X |
| 2,853,012 | 9/1958 | Rotkin et al. | 102/70.2 GI |
| 2,918,006 | 12/1959 | Von Zborowski | 102/56 |
| 3,013,495 | 12/1961 | Stevenson et al. | 102/59 |
| 3,216,320 | 11/1965 | Thomas et al. | 102/22 X |
| 3,256,817 | 6/1966 | Rabinow et al. | 102/70.2 GI |
| 3,277,825 | 10/1966 | Maillard | 102/52 X |

FOREIGN PATENT DOCUMENTS

| | | | |
|---|---|---|---|
| 1,161,445 | 3/1958 | France | 102/24 HC |
| 885,380 | 12/1961 | United Kingdom | 102/24 HC |
| 968,507 | 9/1964 | United Kingdom | 102/24 HC |

*Primary Examiner*—Harold Tudor
*Attorney, Agent, or Firm*—Joseph E. Rusz

[57] ABSTRACT

A projectile for heavy armor formed of a casing having at its forward end a double cone construction, one surrounding the other, to provide an annular space between the cones. This space is filled with an explosive. The inner cone is located nearer the forward end of the projectile and is provided with a series of flutes extending from the apex toward the outer edge. The recesses formed by the flutes contain a part of the explosive provided within the annular space between the cones. Thus, the flutes form shaped charges and since the interior of the cone is presented to the forward end of the projectile, the force of the explosive on contact with the armor produces not only an opening in the target but also linear gashes which extend radially outward from the opening. The remainder of the projectile is formed of a hollow penetrator body which contains explosive for internal blasting and there is a jet propelling explosive at the rear end of the casing for propelling the projectile through the air. The opening blasted in the armor by the double cone structure may be too small for the penetrator body to enter readily but the gashed edge allows the penetrator to bend the cut portions inwardly and thus permit easy access for the penetrator to deliver its explosive to the rear side of the armor.

3 Claims, 8 Drawing Figures

INVENTOR.
DALE M. DAVIS
BY Harry A. Herbert Jr. and
Herbert H. Brown
ATTORNEYS

INVENTOR.
DALE M. DAVIS
BY Harry A. Herbert Jr
Herbert H. Brown and
ATTORNEYS

ARMOR PENETRATING PROJECTILE

The invention described herein may be manufactured and used by or for the United States Government for governmental purposes without payment to me of any royalty thereon.

The present invention relates to warheads used against hard targets by internal blast.

It is extremely difficult to induce large explosive charges into the interior or fairly thick armored vessels to destroy them by internal blast. Even when a preliminary opening is produced by an explosive charge which passes through the armor, the opening is usually so small as not to permit the entry of the main casing of the projectile which carries the full charge of internal explosive. Consequently, the interior blast is not completely effective.

An object of my invention is to provide an improved method and structure by which an internal blasting charge is caused to be driven in its entirety through fairly heavy armor to obtain the maximum blasting effects within the area projected by the armor. This object is attained in brief by producing, not only an opening in the armor at the area of impact but also spaced cuts or gashes radiating from the opening which weaken the metal for a considerable distance away from the opening as will allow the metal segments between the cuts to be bent inwardly when forced by the pressure of the main portion of the projectile. Thus, the initial opening is caused to be greatly enlarged, sufficient to allow the main casing which carries the full internal blasting charge completely to enter and pass through the armor.

The invention will be better understood when reference is made to the following description and accompanying drawings, in which.

Figure 1:
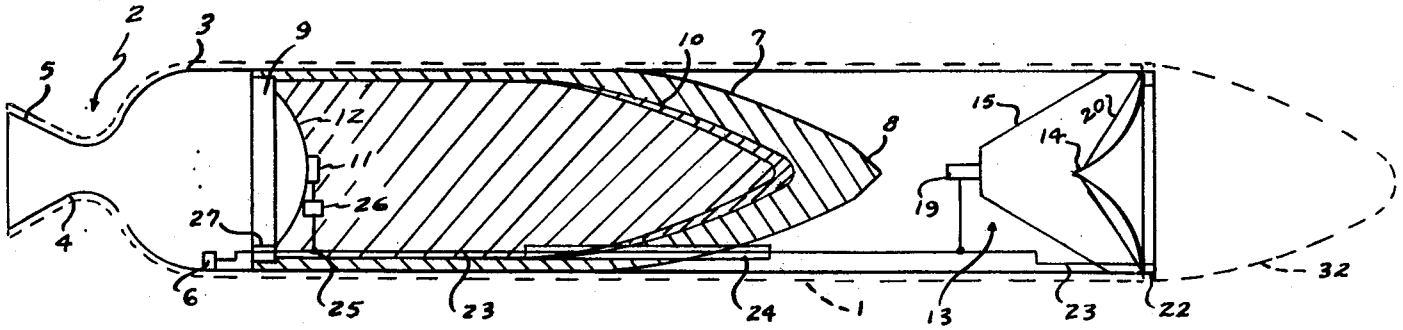
FIG. 1 represents in diagram, a warhead improved in accordance with my invention at the front of a casing which contains an internal explosive charge.

Referring to FIG. 1, reference character 1 designates the main casing of a projectile which is designed to carry a heavy internal blast charge against the armor of an enemy target. The casing is preferably of cylindrical configuration of thin sheet metal. At the tail or rear end there is a rocket device of any suitable and well-known type, indicated generally at 2. This device can be formed of a hemispherical portion 3, of fairly heavy metal, necked down at 4, and is provided with a flared outlet 5. A propelling charge is contained within the portion 3, and when fired by the usual igniter 6 of any suitable and well-known type, gases of combustion are produced at the outlet which increase the speed initially given to the projectile. It will be understood that the latter is given an initial thrust by being released from a fast moving plane or by being launched from a firing platform.

The rocket device is usually started simultaneously or just before the impact on the target in order to increase the force of that impact.

The intermediate content of the casing includes a hardened penetrator body 7 of well-knwon type fitted snugly within the casing. The body is hollow and has a pointed nose, indicated at 8. The latter is of considerable thickness in order to provide a wedging or battering effect upon reaching the target. The penetrator body is closed at the rear end by a relatively thick plate or wall 9 which serves to isolate the contents of the rocket device 2 and its explosive material from the contents of the penetrator body. The front or nose portion of the latter is lined with a shock or buffer pad 10 of any suitable material in order further to insulate the explosive contents from the battering effect of the penetrator nose. The penetrator body 8 contains a heavy charge of explosive material which is set off or fired by an igniter shown generally at 11. The latter is preferably supported on a re-entrant rounded member 12 secured to the wall 9.

Figure 3:
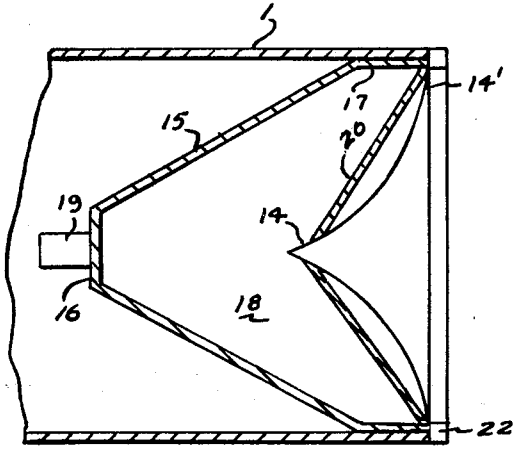
FIG. 3 represents a longitudinal section of the complete warhead including part of the casing. The section is taken along line 3—3 in FIG. 2.
Figure 2:
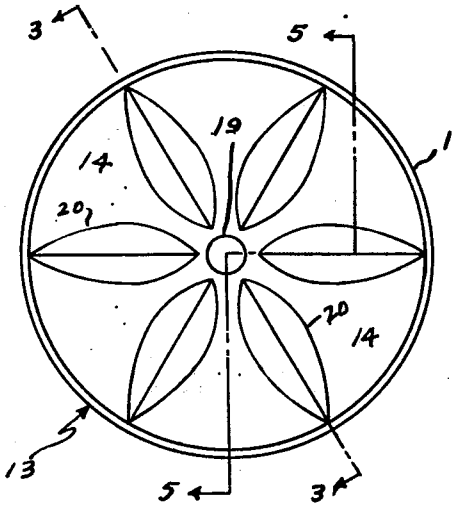
FIG. 2 depicts an end view of a portion of the armor-penetrating warhead.
Figure 4:
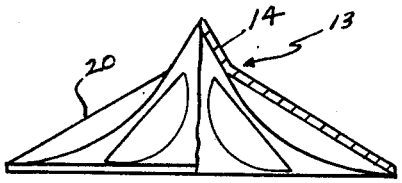
FIG. 4 is a side elevation, partly in section, of the front portion of the warhead, removed from the casing.

For piercing the armor wall of an enemy ship or other target, I employ an improved form of explosive head, shown generally at 13. The latter is suitably secured at the front end of the casing and its details are shown in FIGS. 2, 3, and 4. It is comprised essentially of a cone-shaped element 14 of thin metal which is inverted or re-entrant with respect to the casing. The lower or outer portion of the cone flares outwardly and forms a flat base at 14′ which extends as far as the interior periphery of the casing to which it is secured.

There is another cone-shaped member 15, considerably larger than the element 14, this member having a linear side and a flat top indicated at 16. The outer periphery is defined by a circular rim 17 which fits snugly within the casing and is secured thereto. The member 15 is re-entrant with respect to the casing to leave a large annular and closed compartment 18 between the cone-like structures. This compartment is filled with explosive material. The member 15 is constituted of relatively thin metal such as steel or copper. The shaped charge within the compartment 18 is under the control of an initiator 19 of any suitable and well-known type secured to the flat top of the cone.

Figure 5:
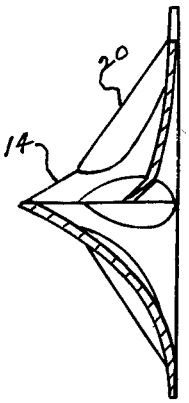
FIG. 5 is a sectional view of the conical warhead. This section is taken along line 5—5 in FIG. 2.

The cone member 14 is provided with a plurality of fluted portions 20 shown in detail in FIGS. 3 and 5, which are located equidistantly about the conical surface. In case there are six such portions, they would be located approximately 60° apart. The flutes take the form, in general, of a sharp, peaked ellipse as seen in FIG. 2 and are pressed out of the metal of the cone. Each flute is considerably larger in length than width and has a straight top edge or ridge, and sloping sides, extending angularly outward and open at the bottom. Each flute is oriented radially outward and downward from the apex of the cone and extends for about three-quarters of the distance between the apex and the base of the cone.

There is a detonator ring 22 (FIG. 1) formed preferably of piezoelectric material secured to the outer border of the base 14′ in any suitable manner. A conductor 23 is taken from the ring, passing through the interior of the casing to the initiator 19. The conductor continues through an insulated tubing 24, positioned in the penetrator head 8 and buffer 10, and then branches at 25 to pass through an impulse delaying device 26 to the igniter 11. The other branch of the conductor extends through an insulated opening 27 in the plate 9 and connects with the igniter 6 in the rocket chamber.

It is well-known that when the piezoelectric ring 22, which, in effect, constitutes a fuze, is compressed as when the projectile first strikes the outer surface of the target, a charge of electricity is produced which passes through the conductor 23 to set off the initiator 19 and the igniter 6 in the rocket chamber. The initiator 19 will immediately cause the material in the compartment 18 to explode, and the pressure developed thereby causes the cone member 14 to collapse and flow as if it were molten, i.e., the concussion effect is far in excess of the strength of the metal.

Figure 6:
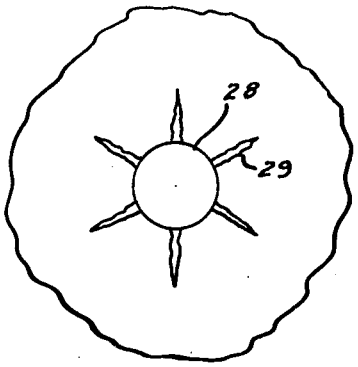
FIG. 6 represents a fragmentary diagram, in plan, of a section of armor in which an opening together with the radial cuts have been produced by the improved warhead.

The cone 14, during its collapse, serves to direct the tremendous explosive energy toward and into the metal of the target to produce an opening 28. The open flutes, upon detonation of the explosive, behaves as liners in a linearly-shaped charge to form cutting jets. The opening 28 is usually too small to permit the entry of the complete missile. However, the cutting jet effect provided by the flutes or liners produces gashes 29 at about 60° apart outwardly from the small opening as indicated in FIG. 6.

Figure 7:
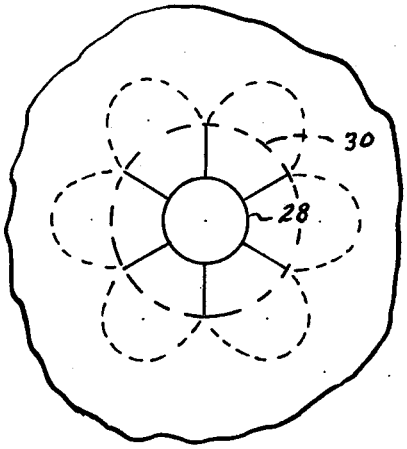
FIG. 7 illustrates by way of diagram, in plan, the manner in which the metal between the radial cuts can be bent outwardly and against the interior surface of the target metal by the entering projectile.
Figure 8:
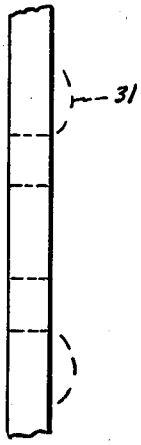
FIG. 8 depicts a sectional view, partly in diagram, to indicate the so-called "petaling" effect.

The impulse rocket 2 will also be fired simultaneously with the head 13 on account of the electrical impulses derived from the fuze ring 22 and the driving power of the rocket will cause the entire casing 1 to be propelled at considerable speed and therefore forced against the target area which has been penetrated and cut by the improved head. Consequently, the penetrator body 7, which is of hardened steel and of considerable thickness and weight, will pass through the opening 28 and the tapered sides of this body will continue to go through the armor, causing the segmental mass of metal between the cuts, if not already removed by the blast of charge 18, to be bent inwardly along a line 30 (FIG. 7) to produce a "petaling" effect as indicated at 31 (FIG. 8). Thus, the entire casing 1 will have been able to enter through the opening illustrated by the improved conical structure 13 which has been effectively enlarged by the use of the radiating cuts 29. The casing is given at this time considerable impetus inwardly by the effect of the impulse rocket member 2.

When the entire length of the casing has penetrated the armor in the manner described, the igniter 11 will have been activated by the impulse delayed at the element 26 so that the full high internal explosive charge contained within the penetrator body will now be exploded. This explosion in effect would take place, for example, within a ship's hull where it would do the maximum damage.

It will be understood that the buffer element 10 serves to prevent the detonator of the high explosive charge within the penetrator body during the series of impacts of the casing with the target area, so that the contents of the penetrator body will be ready to be ignited solely by the stimulus furnished by the igniter 11.

While I have shown the delay effect at the igniter 11 as constituting a separate element 26, it will be further understood that the impulse delay feature could be built directly into the igniter to serve this purpose as is well known in the art. Moreover, it might also be desirable to provide a well-known type of frangible ballistic nose indicated by dotted lines 32 (FIG. 1) to cut down air or water resistance, so as to allow the projectile to arrive at the target area with the maximum impact furnished by its initial speed as supplemented by the driving force of the rocket.

While a certain specific embodiment has been described, it is obvious that numerous changes may be made without departing from the general principle and scope of the invention.

I claim:

1. An armor penetrating projectile comprising a casing having at its rear end an impulse rocket and at its front end an armor penetrating head, said casing containing the hollow penetrator body positioned between said head and the rocket, said penetrator body containing an internal blast explosive material, said head comprising a cone structure containing a charge of explosive material which upon being exploded serves to form an opening in the target armor, and means forming part of the cone structure for producing a series of gashes radiating from the opening in order to weaken the metal about the opening, said means comprising a plurality of equidistantly spaced flutes positioned about the surface of the cone and extending radially outwardly and downwardly from the apex of the cone, the recesses between the flutes containing linear shaped charges of explosive whereby when said charges are exploded, the penetrator body and its internal blast explosive are permitted ready entrance through an enlargement of said opening caused by deforming the metal at said gashes.

2. An armor penetrating projectile according to claim 1 and in which said cone structure includes a plurality of metal members of conical form, one surrounding the other to leave an annular space therebetween, a charge of explosive filling said space, the concavity of the inner cone being presented to the forward end of the projectile and provided with the aforesaid flutes whereby the open sides of the flutes form individual shaped charge effects of linear configuration for the explosive in said annular space.

3. An armor penetrating projectile according to claim 2 and in which the conically shaped members are of different angularity and the convexity of both conical members is directed toward the rear of the projectile, said cone of larger size having a flat portion at its apex for receiving an explosion-initiating device.

* * * * *